US007647874B2

(12) United States Patent
Kohnen

(10) Patent No.: US 7,647,874 B2
(45) Date of Patent: Jan. 19, 2010

(54) ENERGY AND STEEL RECOVERY SYSTEM

(75) Inventor: Robert L. Kohnen, Springboro, OH (US)

(73) Assignee: Symbiotic Technology LLC, Springboro, OH (US)

( * ) Notice: Subject to any disclaimer, the term of this patent is extended or adjusted under 35 U.S.C. 154(b) by 320 days.

(21) Appl. No.: 10/908,525

(22) Filed: May 16, 2005

(65) Prior Publication Data

US 2006/0254482 A1 Nov. 16, 2006

(51) Int. Cl.
*F23B 1/02* (2006.01)

(52) U.S. Cl. ..... 110/295; 110/208

(58) Field of Classification Search ..... 110/295, 110/296, 297, 302, 305, 308, 314, 208, 209, 110/229

See application file for complete search history.

(56) References Cited

U.S. PATENT DOCUMENTS

| | | | | | |
|---|---|---|---|---|---|
| 2,124,122 | A * | 7/1938 | Raisch | 110/225 |
| 3,946,680 | A | 3/1976 | Laman | 110/257 |
| 4,052,173 | A | 10/1977 | Schulz | 48/202 |
| 4,084,521 | A * | 4/1978 | Herbold et al. | 110/242 |
| 4,091,747 | A * | 5/1978 | Chase | 110/210 |
| 4,201,141 | A * | 5/1980 | Teodorescu et al. | 110/259 |
| 4,203,804 | A | 5/1980 | Janning | 202/121 |
| 4,488,398 | A | 12/1984 | Noguchi | 60/39.12 |
| 4,530,702 | A | 7/1985 | Fetters | 48/209 |
| 4,635,573 | A | 1/1987 | Santen | 110/346 |
| 4,650,546 | A | 3/1987 | Le Jeune | 201/6 |
| 4,732,092 | A * | 3/1988 | Gould | 110/229 |
| 5,167,772 | A | 12/1992 | Parker | 202/105 |
| 5,226,375 | A | 7/1993 | Fukuda | 110/346 |
| 5,230,777 | A | 7/1993 | Jarrell | 202/97 |
| 5,380,352 | A | 1/1995 | Greenwalt | 75/445 |
| 5,852,062 | A | 12/1998 | Carpenter | 521/41 |
| 6,932,002 | B2 * | 8/2005 | May et al. | 110/345 |

* cited by examiner

*Primary Examiner*—Kenneth B Rinehart
(74) *Attorney, Agent, or Firm*—R. William Graham

(57) ABSTRACT

An energy and steel recovery system has a suspension column and a plurality of suspension burners operably disposed therein wherein the burners are laterally spaced from one another along the length of thereof. The suspension column includes a mechanism for receiving tires onto one of the burners and feeding the tired to an adjacent downwardly disposed burner to further combust the same. A first conduit includes a first end communicably connected to the suspension column and a second end communicably connected to a boiler wherein air flow passes from the boiler to the suspension column. A second conduit includes a first end communicably connected to the suspension column and a second end communicably connected to the boiler wherein air flow passes from the suspension column to the return air flow path of the boiler. The system includes a mechanism for removing residual waste materials from the suspension column.

16 Claims, 7 Drawing Sheets

ENERGY AND STEEL RECOVERY SYSTEM

BACKGROUND OF INVENTION

Field of Invention

This invention relates to improvements in energy and steel recovery systems. More particularly, the invention relates to a system for recovering energy and steel through combustion of tires in suspension in a slipstream of a high energy user. This invention allows an efficient use of the heating power of waste materials, preferably solids such as whole vehicle tires, and also other waste materials in bulk or crushed form to reduce fuel consumption expenses in large capacity boiler systems.

Currently, such alternative waste derived fuels have been operably disposed within a pyrolysis chamber or a riser duct of a kiln. The use of such waste products is a function of the burning environment, for example, the amount of heat required and oxygen content within the chamber or kiln. In the cement industry, rotary furnaces require large amounts of fuel, particularly of the liquid and gas types to achieve the high temperatures needed in the range of 900 degree C. and above, for example. These temperatures are capable of burning or incinerating all sorts of materials that may be fed to such furnaces.

Such chambers and furnaces are highly effective and efficient devices for elimination of waste, particularly environmentally hazardous, and through full and absolute combustion, due to the high temperatures they reach. They are capable of disintegrating hazardous waste into their more basic components, such as carbon dioxide, nitrogen gases, etc. Also combustion residues as well as non-combusted non-hazardous components, such as metals, from many waste materials can be safely used, such as the incorporation thereof in a cement clinker product.

Attempts have been made in industrialized countries, since the end of the past century, to reduce fuel costs through the use of alternative fuels in place of traditional fuels. Among the latter, tires have been found to be highly suitable There remains a need to improve such technology to provide a highly efficient, easily operated, low cost, system for using such fuels.

SUMMARY OF THE INVENTION

An object of the invention is to improve boiler technology.

Another object is to improve efficiency of boiler technology.

Still another objective of this invention is to enhance the process in which waste material is burned within a suspension system.

Accordingly, the invention is directed to an energy and steel recovery system. The system has a suspension column and a plurality of suspension burners operably disposed in the suspension column wherein the burners are laterally spaced from one another along the length of the suspension column. The suspension column includes means for receiving the combustible material onto one of the burners and feeding, e.g., via gravity feeding, the combustible material to an adjacent downwardly disposed burner to further combust the combustible material. A first conduit includes a first end communicably connected to a heated air path of the suspension column and a second end communicably connected to an outflow air path of a boiler wherein air flow passes from the outflow air path of the boiler to heated air flow path of the suspension column. A second conduit includes a first end communicably connected to the heated air flow path of the suspension column and a second end communicably connected to a return air flow path of the boiler wherein air flow passes from the heated air flow path of the suspension column to the return air flow path of the boiler. The system further includes means for removing residual combusted and non-combustible waste materials from the suspension column.

Preferably, the suspension column can be equipped with an outer air passage jacket surrounding an inner column wall to which the first and second conduits are communicably connected. In this way, the air enters the jacket and passes through the jacket being heated from the outer surface of the inner wall without mixing with air from the combustion occurring within the inner wall. Each suspension burner includes a plurality of support fingers each having a waste derived fuel support surface which is removably disposed in the suspension column to provide for self cleaning of the support surface of the fingers upon removal from the suspension column. Preferably, the suspension burner includes means for automatically retracting the fingers from the column. Further, means for automatically feeding the waste material on to the fingers of the suspension burner are provided.

The present invention is particularly useful in providing additional heating energy to high energy user systems, such as boilers and using a novel a structure and method and provides an automated feed of waste materials, preferably tires, into a suspension column. Upon burning tires, residual metals from within the tires pass by virtue of their weight and gravity to the residual waste removal means where the metals, i.e., steel wires from tires can be removed. With the use of the invention, it is contemplated that the alternative waste energy including at least partially combustible organic-containing waste can provide a substantial amount of the heat required for heating high energy user systems, such as a boiler. Novelty of the invention will be apparent hereinafter as discussed more fully below and other objectives and advantages of this invention will be apparent from reading the drawings and description hereinafter.

DETAILED DESCRIPTION OF THE PREFERRED EMBODIMENTS

Figure 1:
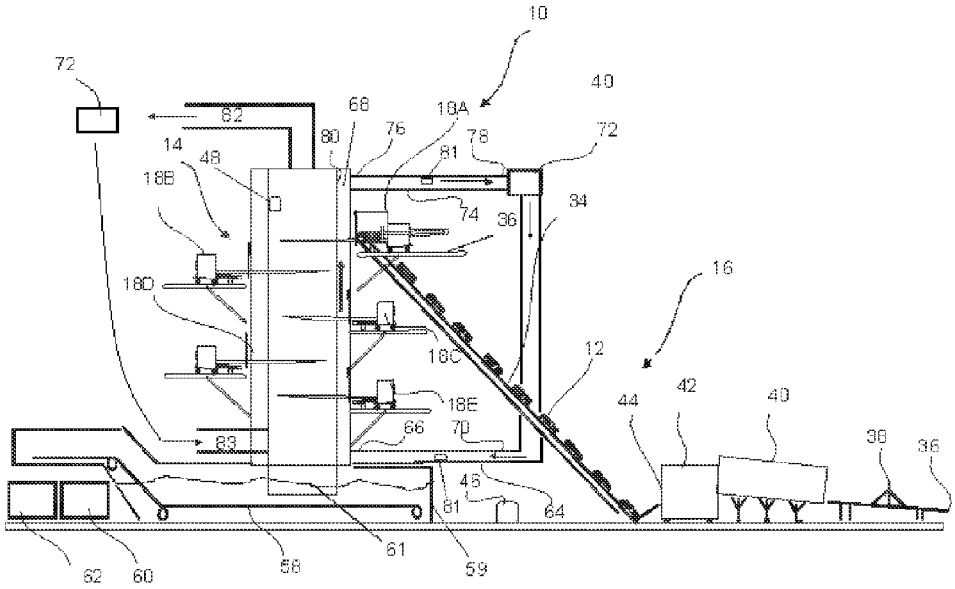
FIG. 1 is a side elevation diagrammatic view embodying the invention, especially the suspension column with suspension burners.

Referring now to the drawings, an energy and steel recovery system is generally referred to by the numeral 10. The alternative fuel, which can preferably be combustible waste tires 12, is fed to a suspension column 14 by feeding means 16. The suspension column 14 can preferably include and a plurality of suspension burners 18A, 18B, 18C, 18D, 18E which are operably disposed in the suspension column 14 wherein the suspension burners 18A, 18B, 18C, 18D, 18E are laterally spaced from one another along the vertical length of the suspension column 14. The number of suspension burners 18A, 18B, 18C, 18D, 18E and spacing therebetween can be varied to accommodate the length and size of the suspension column 14 as well as the material to be combusted. For example, spacing can be to provide that the tires 12 be readily removable from an upwardly disposed suspension burner 18A to burner 18B. Each of the suspension burners 18A, 18B, 18C, 18D, 18E are similar in design and operation and like numbers are intended to describe like parts with the exception that burner 18A is connected to additional components described hereinafter.

In this regard, suspension burner 18A connects to housing 24 which includes an exterior gate 20 and an interior gate 22 which provide an airlock during injection of tire 12 into the suspension column 14. The exterior gate 20 is opened while the interior gate 22 is closed to pass waste derived fuel material into a burner housing 24. The exterior gate 20 is closed while the interior gate 22 is opened to pass tires 12 from burner housing 24 into the suspension column 14.

The suspension burner 18A includes a plurality of support fingers 26A each having a waste support surface 28A which are removably disposed in the suspension column 14 through slotted open surface 19A to provide for self cleaning of the support surface 28A of the fingers 26A upon removal from the column 14. In this regard, slotted surfaces 32A can be formed in a face of the column 14 through which the fingers 26A move back and forth to effect the removal of the residual waste 13.

Preferably, the suspension burner 18A includes means 30A for automatically retracting the fingers 26A from the column 14. The means 30A can include a motor 31A and a linear actuator 33A which is operably interconnected to the movable housing 52 and fingers 26A. The means 30A sit on a platform 56.

As for the feeding tires 12, means 16 are provided for automatically feeding the tires 12 to the burner 18A onto the fingers 26A of the suspension burner 18A. Feeding means 16 can include an inclined elevator belt 34 wherein the tires 12 are placed and elevated thereby to the housing 24 through gate 20. A truck ramp 36 is operably disposed adjacent a trailer tipper 38 for enabling dumping tires 12 into a hopper 40. A rotating disk tire separator 42 is operably disposed to the hopper 40 and separates tires 12 into an accumulator 44 for inspection. Unsuitable tires can rejected onto a reject conveyor belt (not shown), while accepted tires 12 are fed onto the inclined conveyor belt 34. Such feed is controlled by means of a controller 46 which is operably connected to a sensor 48 located in the suspension column 14 to sense when the conditions are suitable for combustion to take place for the next in line tire 12.

Figure 2A:
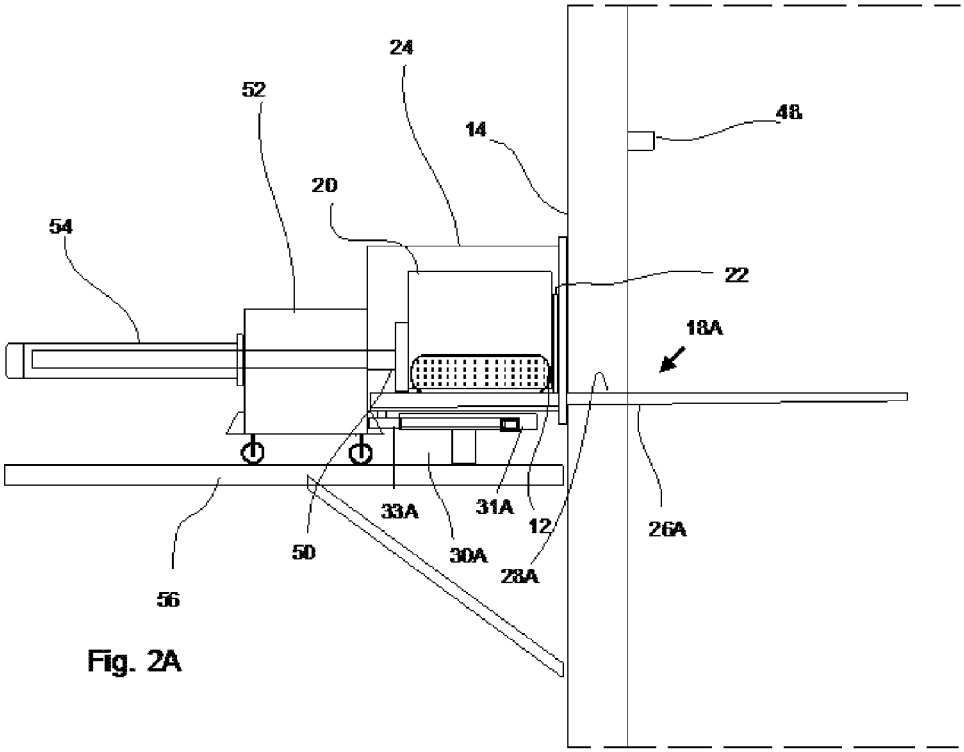
FIG. 2A is a view illustrating a first mode of a burner of the instant invention.
Figure 2B:
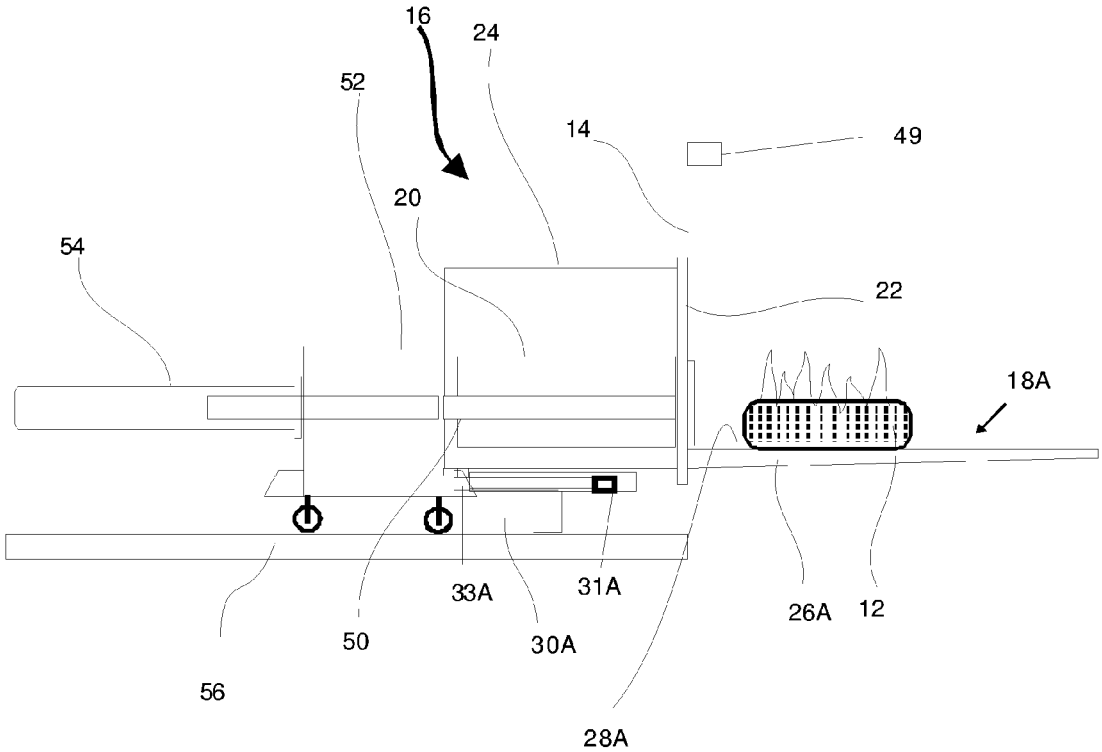
FIG. 2B is a view illustrating a second mode of the burner of FIG. 2A.

As seen in FIGS. 2A and 2B, a linear actuated ram 50 is partially operably disposed in housing 52 and casing 54 connected to the housing 24 and is controllably moved back and forth through burner housing 24. The controller 46 receives a signal to feed a tire 12 and initiate the ram 50 to push the tire 12 from the burner housing 24 into the suspension column 14 and onto the suspension fingers 26A. The tire 12 is burned within the suspension column 14. Tires 12 may also be introduced mechanically onto the suspension burner 18A by other means such as a screw feed or other similar device (not shown).

Figure 3A:
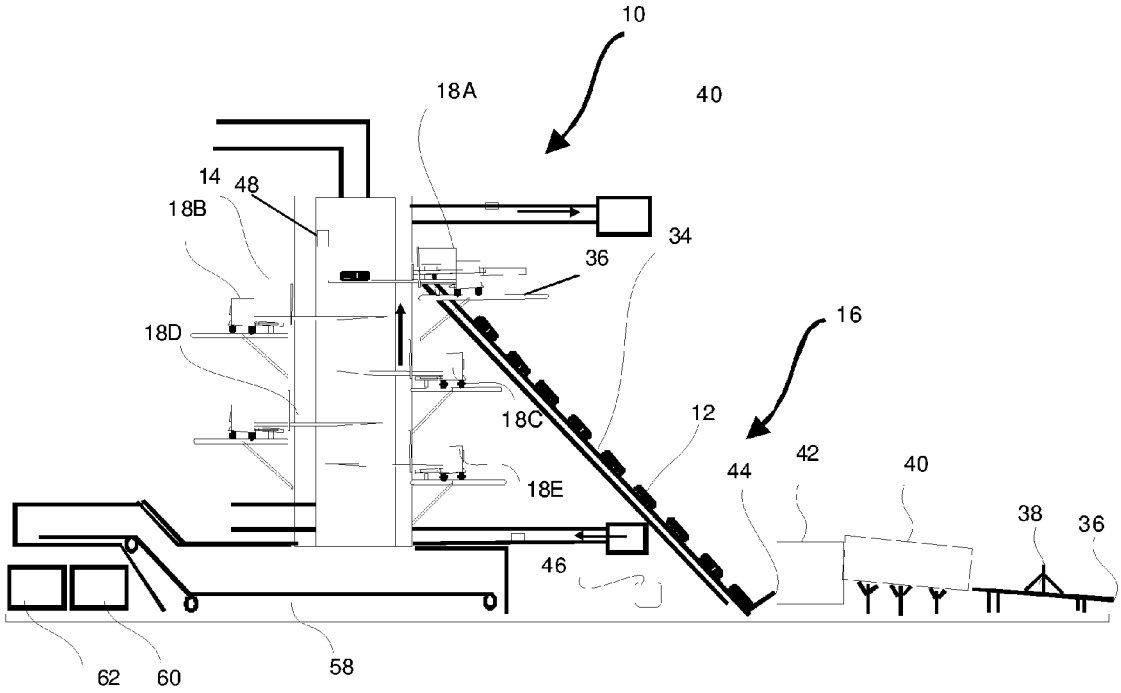
FIG. 3A is another view illustrating the second mode of the invention.
Figure 3B:
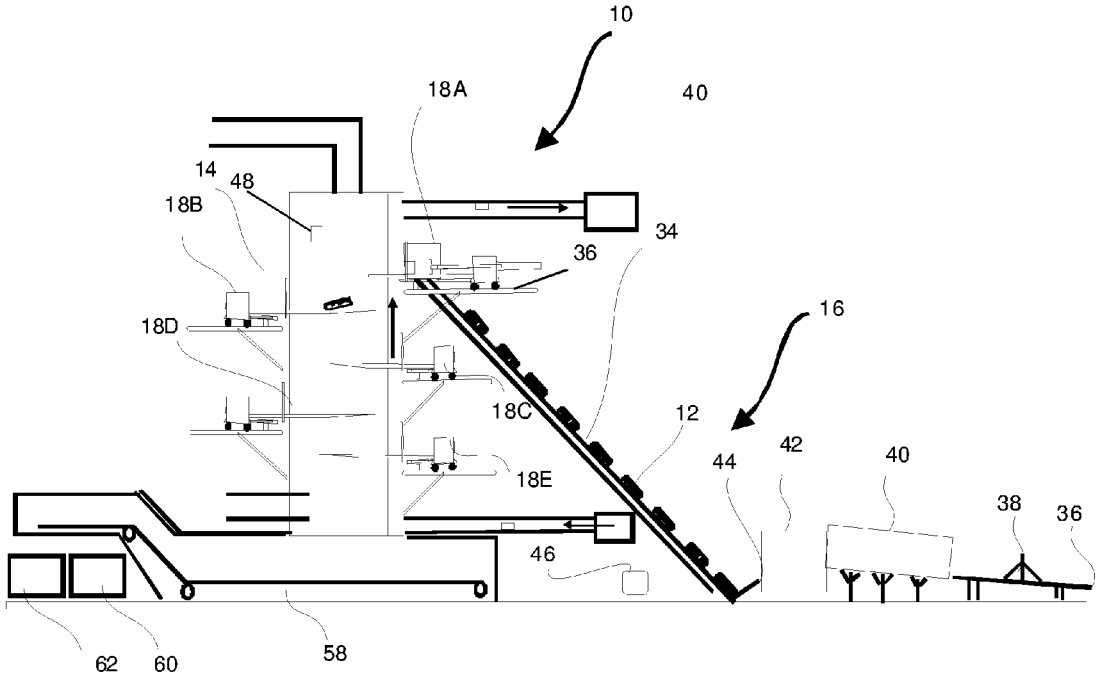
FIG. 3B is a view illustrating a third mode of the burner of the instant invention wherein combusted material has moved to a lower burner.
Figure 3C:
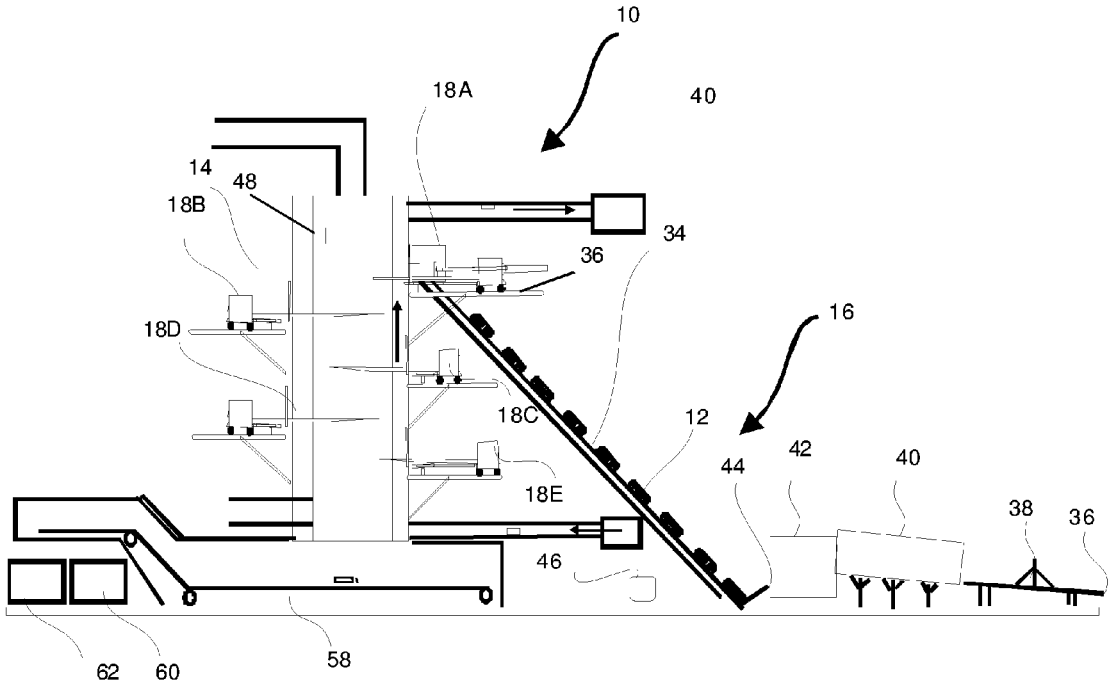
FIG. 3C is a view illustrating a fourth mode of the burner of the instant invention wherein combusted material has moved to a recovery conveyor.
Figure 4:
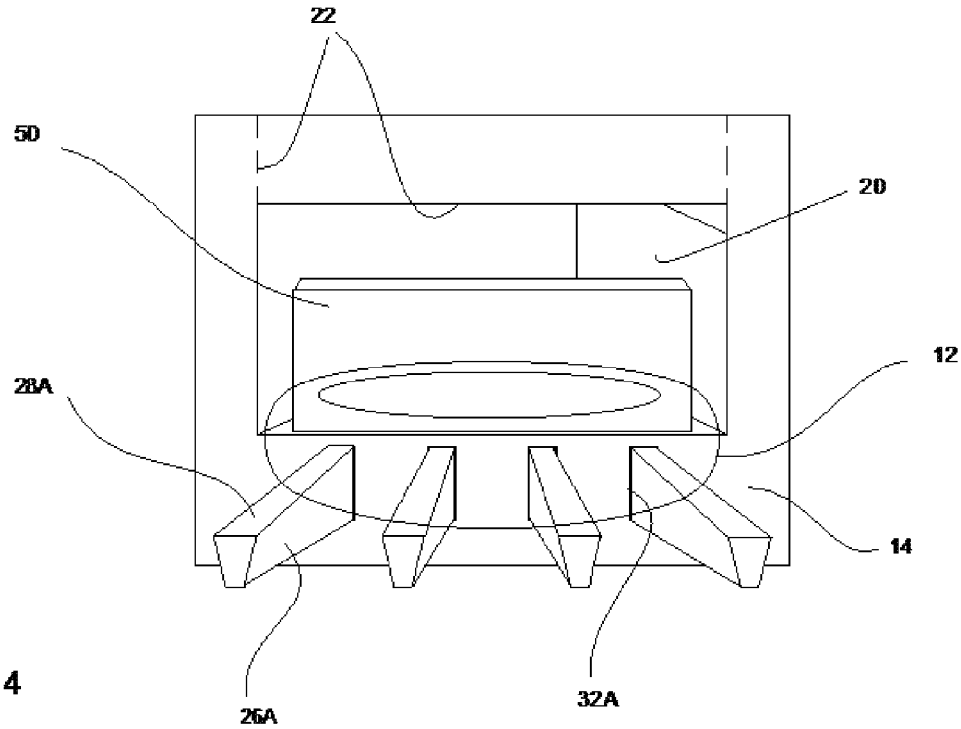
FIG. 4 is a perspective view of a burner of the instant invention.

FIGS. 3A-3C show several of the steps of wherein the tires 12 are burned and residual of tires 12 is further gravity fed, such as to a lower burner 18B and ultimately dispensed onto a drop-out conveyor 58 which can be a chain drag out assembly operably disposed in a vessel 59. A water seal 61 is provided by virtue of inner column wall 80 of column 14 extending below water level. In this way, the introduction of tramp air is isolated from entering the combustion zone and the system 10 only introduces slip stream air from boiler 72 as is apparent herein. A steel or metal roll-off container 60 and residual ash roll-off container 62 are provided wherein the conveyor 58 can be equipped to automatically separate the residual ash and metal, such as via incorporating a magnetic conveyor.

A first conduit 64 includes a first end 66 which can be communicably connected to a heated air flow path defined by an annular jacket 68 of the suspension column 14 and a second end 70 communicably connected to an outflow air path of a high energy consumption device, such as a boiler 72, wherein air flow passes from the boiler 72 to the jacket 68. A second conduit 74 includes a first end 76 communicably connected to the heated air flow path of the jacket 68 and a second end 78 communicably connected to a return air flow path of the boiler 72 wherein air flow passes from the jacket 68 to the boiler 72. It is contemplated that the column 14 and jacket 68 can be used for hot air, steam or hot oil to recover heat generated.

The preferred embodiment shows that the suspension column 14 can be equipped with the outer air passage jacket 68 surrounding an inner column wall 80, although it is envisioned that other air channels can be configured. In this way, the air enters the jacket 68 and passes therethrough being heated from the outer surface of the inner wall 80 without mixing air from combustion occurring within the inner wall 80. The system 10 includes air blowers 81 of the type known to circulate air through the described air flow path. Also, a vent 82 is provided on the column 14 and duct 83 connects through jacket 68 to column 14. In this regard, a slip stream of the boiler 72 combustion gases can be fed through duct 83 and fed back to the boiler 72 via vent 82. Thus, heat is recovered from the jacket 68 as well as boiler 72 through reintroduction of combustion gases and there provides a heat recovery boiler.

The above described embodiments are set forth by way of example and are not for the purpose of limiting the present invention. It will be readily apparent to those skilled in the art that obvious modifications, derivations and variations can be made to the embodiments without departing from the scope of the invention. Accordingly, the claims appended hereto should be read in their full scope including any such modifications, derivations and variations.

What is claimed is:

1. An energy and steel recovery system, which includes a suspension column;

a plurality of suspension burners operably removably disposed in said suspension column wherein said burners are laterally spaced from one another along the length of said suspension column and permit continual unrestricted air flow through said suspension column wherein each said suspension burner includes a plurality of laterally spaced support fingers each having a waste derived fuel support surface which is removably disposed in said suspension column, said column having a plurality of slotted surfaces through which said support fingers extend, each said slotted surface configured to receive one said finger therethrough to provide for self cleaning of said support surface of said fingers upon removal from said suspension column and wherein each said suspension burner includes means for automatically retracting said fingers from said suspension column;

a housing external to said column for receiving combustible waste having steel matter therein, said housing having an exterior gate and an interior gate in communication with said column in a manner to open and close communication between said housing and exterior gate and said column wherein said gates and housing provide an airlock when injecting said waste onto one of said burners which is movably disposed in said housing and moves said support fingers from said housing through said slotted surfaces into said column to be upwardly disposed within said column and enable combustion of said combustible waste and upon retraction of said support fingers feeding said combustible waste material to another of said burners which is downwardly disposed to further combust said combustible material;

an air inlet connected at a lower end of said suspension column for introducing heated air therein;

a vent connected to an upper end of said suspension column; and wherein said suspension column includes an outer air passage jacket surrounding an inner column wall to which one end of a first conduit and one end of a second conduit are communicably connected such that air enters said jacket via said first conduit and passes through said outer air passage jacket being heated from an outer surface of said inner column wall and exits out through said second conduit and wherein another end of each said first conduit and said second conduit are communicably connected to deliver separate heated air to a high energy consumption device in a manner wherein air passes from said second conduit to said high energy consumption device back to said first conduit.

2. The energy and steel recovery system of claim 1, further including means for removing residual combusted and non-combustible waste materials from said suspension column.

3. The energy and steel recovery system of claim 2, wherein said waste removing means includes a conveyor system downwardly disposed in said suspension column.

4. The energy and steel recovery system of claim 3, wherein said conveyor system includes a magnetic conveyor.

5. The energy and steel recovery system of claim 1, wherein said suspension burner includes means for automatically retracting said fingers from said column.

6. The energy and steel recovery system of claim 1, which further includes means for automatically feeding said combustion waste material on to said fingers of said suspension burner.

7. The energy and steel recovery system of claim 1, which further includes means for automatically feeding said combustible waste onto said upwardly disposed suspension burner.

8. The energy and steel recovery system of claim 1, which further includes means for circulating said air through said conduits and said jacket.

9. The energy and steel recovery system of claim 1, which further includes a vent for venting combusted air from said suspension column.

10. The energy and steel recovery system of claim 1, wherein said waste includes tires.

11. The energy and steel recovery system of claim 1, which further includes means disposed in said suspension column for sensing when conditions are suitable for combustion to take place and thereby receiving additional waste to be converted to fuel in said suspension column.

12. A method of producing energy and steel recovery, comprising:

(a) delivering a combustible tire having steel matter therein to housing for receiving said tire onto a burner movably disposed therein, said burner including a plurality of laterally spaced support fingers each having a waste derived fuel support surface which is removably disposed in said suspension column, said housing having an exterior gate and an interior gate in communication with said column in a manner to open and close communication between said housing and exterior gate and said column and wherein said exterior gate is open when receiving said tire and said interior gate is closed, wherein said gates and housing provide an airlock when injecting said tire onto said burner;

(b) passing said tire from said housing to said column by moving said support fingers from said housing through slotted surfaces in said column to upwardly dispose said tire in said column and enable combustion thereof and upon retraction of said support fingers pass combusted tire to a downwardly disposed suspension burner subsequent to closing said exterior gate and opening said interior gate, said gates providing an airlock, wherein said downwardly disposed suspension burner is operably disposed in a suspension column in a manner to permit receipt of said combustible tire and suspension of said tire thereon, wherein said suspension column includes a plurality of adjacent suspension burners operably removably disposed in said suspension column wherein said burners are laterally spaced from one another along the length of said suspension column in a manner to permit unrestricted air flow through said suspension column, wherein each burner includes a plurality of laterally spaced support fingers each having a waste derived fuel support surface which is removably disposed in said suspension column by moving said fingers through slotted surfaces formed in said column to individually receive each finger therethrough;

(c) feeding said combustible tire to an adjacent downwardly disposed burner by means of removing said upwardly disposed burner from said column suspending said tire and scraping said tire from said support surface of said upwardly disposed burner and gravity feeding said tire to said downwardly disposed burner to further combust said combustible tire;

(d) capturing heat liberated from said combustion;

(e) sensing when conditions are suitable for combustion to take place and thereby introducing a tire in said suspension column upon sensing such condition; and (f) removing residual steel matter.

13. The method according to claim 12, which further includes forming an air path across a surface of said suspension column and directing said air path to a high energy use device.

14. The method according to claim 12, wherein said removing means is performed automatically.

15. The method according to claim 12, wherein said combustible waste passes from one said burner to said adjacent burner by means of removing said upwardly disposed suspension burner suspending said waste and scraping said waste from a support surface of said upwardly disposed suspension burner and gravity feeding said waste to said downwardly disposed suspension burner.

16. The method according to claim 12, wherein the step (e) is further characterized to introduce additional waste to be converted to fuel.

* * * * *